US009752774B2

(12) United States Patent
Wang et al.

(10) Patent No.: US 9,752,774 B2
(45) Date of Patent: Sep. 5, 2017

(54) FUEL NOZZLE

(71) Applicant: PRATT & WHITNEY CANADA CORP., Longueuil (CA)

(72) Inventors: Yen-Wen Wang, Mississauga (CA); Nigel Davenport, Hillsburgh (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 565 days.

(21) Appl. No.: 14/505,787

(22) Filed: Oct. 3, 2014

(65) Prior Publication Data

US 2016/0097538 A1 Apr. 7, 2016

(51) Int. Cl.

| | |
|---|---|
| ***F23D 1/00*** | (2006.01) |
| ***F23D 11/10*** | (2006.01) |
| ***F23D 11/38*** | (2006.01) |
| ***F23R 3/28*** | (2006.01) |
| ***F23R 3/12*** | (2006.01) |

(52) U.S. Cl.

CPC ..... *F23D 11/107* (2013.01); *F23D 11/102* (2013.01); *F23D 11/103* (2013.01); *F23D 11/383* (2013.01); *F23R 3/12* (2013.01); *F23R 3/286* (2013.01); *F23D 2900/14021* (2013.01)

(58) Field of Classification Search

CPC .... F23D 11/103; F23D 11/102; F23D 11/383; F23D 2900/14021; F23R 3/286; F23R 3/12

See application file for complete search history.

(56) References Cited

U.S. PATENT DOCUMENTS

| | | | | |
|---|---|---|---|---|
| 4,133,485 | A * | 1/1979 | Bouvin | B01F 5/0614 138/42 |
| 5,813,847 | A | 9/1998 | Eroglu et al. | |
| 6,276,141 | B1 | 8/2001 | Pelletier | |
| 6,289,676 | B1 | 9/2001 | Prociw et al. | |
| 6,289,677 | B1 | 9/2001 | Prociw et al. | |
| 7,454,914 | B2 | 11/2008 | Prociw | |
| 7,766,251 | B2 | 8/2010 | Mao et al. | |
| 8,096,135 | B2 | 1/2012 | Caples | |
| 8,636,504 | B2 * | 1/2014 | Krieger | F23D 11/107 239/406 |
| 9,212,823 | B2 * | 12/2015 | Boardman | F23R 3/286 |
| 2007/0101727 | A1 * | 5/2007 | Prociw | F23D 11/105 60/776 |
| 2014/0090382 | A1 | 4/2014 | Sandelis et al. | |
| 2014/0090394 | A1 | 4/2014 | Low et al. | |

* cited by examiner

*Primary Examiner* — Pascal M Bui Pho
*Assistant Examiner* — Katheryn Malatek
(74) *Attorney, Agent, or Firm* — Norton Rose Fulbright Canada LLP

(57) ABSTRACT

A fuel nozzle for a combustor of a gas turbine engine includes a body defining an axial direction and a radial direction, an air passageway defined axially in the body, and a fuel passageway defined axially in the body radially outwardly from the air passageway. The air passageway has a swirl-inducing relief defined at an exit lip of an outer wall of the air passageway. A gas turbine engine and a method of inducing swirl in an air passageway of a fuel nozzle of a gas turbine engine are also presented.

10 Claims, 3 Drawing Sheets

FUEL NOZZLE

TECHNICAL FIELD

The application relates generally to gas turbines engines combustors and, more particularly, to fuel nozzles.

BACKGROUND

Gas turbine engine combustors employ a plurality of fuel nozzles to spray fuel into the combustion chamber of the gas turbine engine. The fuel nozzles atomize the fuel and mix it with the air to be combusted in the combustion chamber. The atomization of the fuel and air into finely dispersed particles occurs because the air and fuel are supplied to the nozzle under relatively high pressures. The fuel could be supplied with high pressure for pressure atomizer style or low pressure for air blast style nozzles providing a fine outputted mixture of the air and fuel may help to ensure a more efficient combustion of the mixture. Finer atomization provides better mixing and combustion results, and thus room for improvement exists.

SUMMARY

In one aspect, there is provided a fuel nozzle for a combustor of a gas turbine engine, the fuel nozzle comprising: a body defining an axial direction and a radial direction; an air passageway defined axially in the body, the air passageway having a swirl-inducing relief defined at an exit lip of an outer wall of the air passageway; and a fuel passageway defined axially in the body radially outwardly from the air passageway.

In another aspect, there is provided a gas turbine engine comprising: a combustor; and a plurality of fuel nozzles disposed inside the combustor, each of the fuel nozzles including: a body defining an axial direction and a radial direction; an air passageway defined axially in the body; and a fuel passageway defined axially in the body radially outwardly from the air passageway, the air passageway having a swirl-inducing relief defined at an exit lip of an outer wall of the air passageway, the swirl-inducing relief inducing swirl to pressurised air exiting the air passageway.

In a further aspect, there is provided a method of inducing swirl in an air passageway of a fuel nozzle of a gas turbine engine, the method comprising: carrying pressurised air through a core air passageway in the fuel nozzle; and directing the pressurised air through a swirl-inducing relief and inducing swirl in the pressurised air exiting the air passageway, the swirl-inducing relief being disposed at an exit lip of an outer wall of the air passageway.

BRIEF DESCRIPTION OF THE DRAWINGS

Reference is now made to the accompanying figures in which.

DETAILED DESCRIPTION

Figure 1:
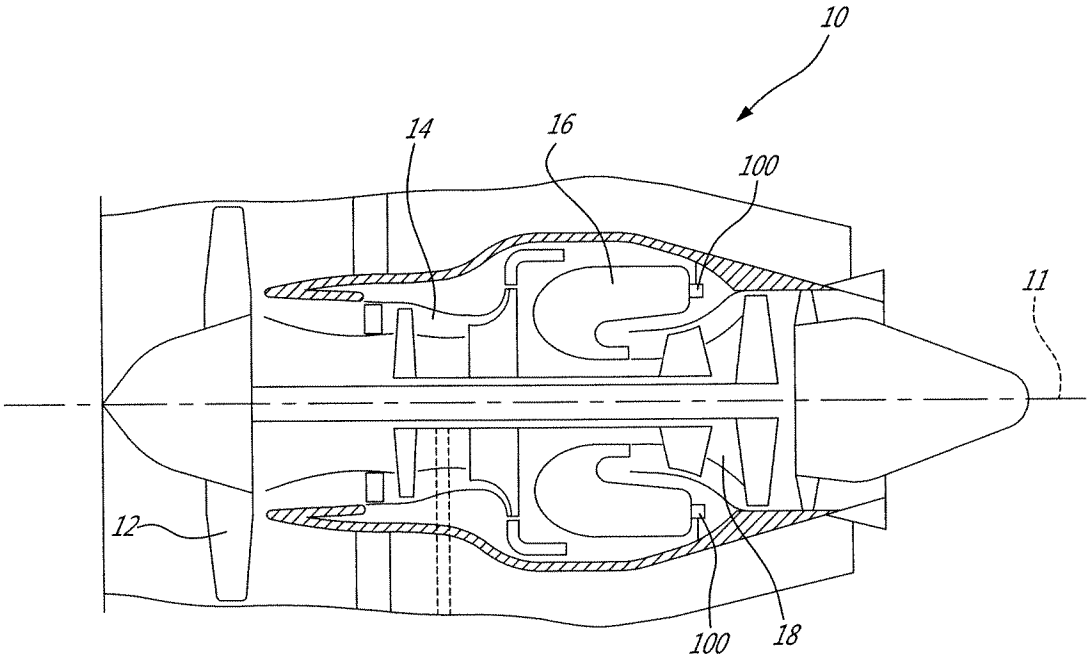
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has one or more fuel nozzles 100 which supply the combustor 16 with the fuel which is combusted with the air in order to generate the hot combustion gases. The fuel nozzle 100 atomizes the fuel and mixes it with the air to be combusted in the combustor 16. The atomization of the fuel and air into finely dispersed particles occurs because the air and fuel are supplied to the nozzle 100 under relatively high pressures. The fuel could be supplied with high pressure for pressure atomizer style or low pressure for air blast style nozzles providing a fine outputted mixture of the air and fuel may help to ensure a more efficient combustion of the mixture. The nozzle 100 is generally made from a heat resistant metal or alloy because of its position within, or in proximity to, the combustor 16.

Figure 2:
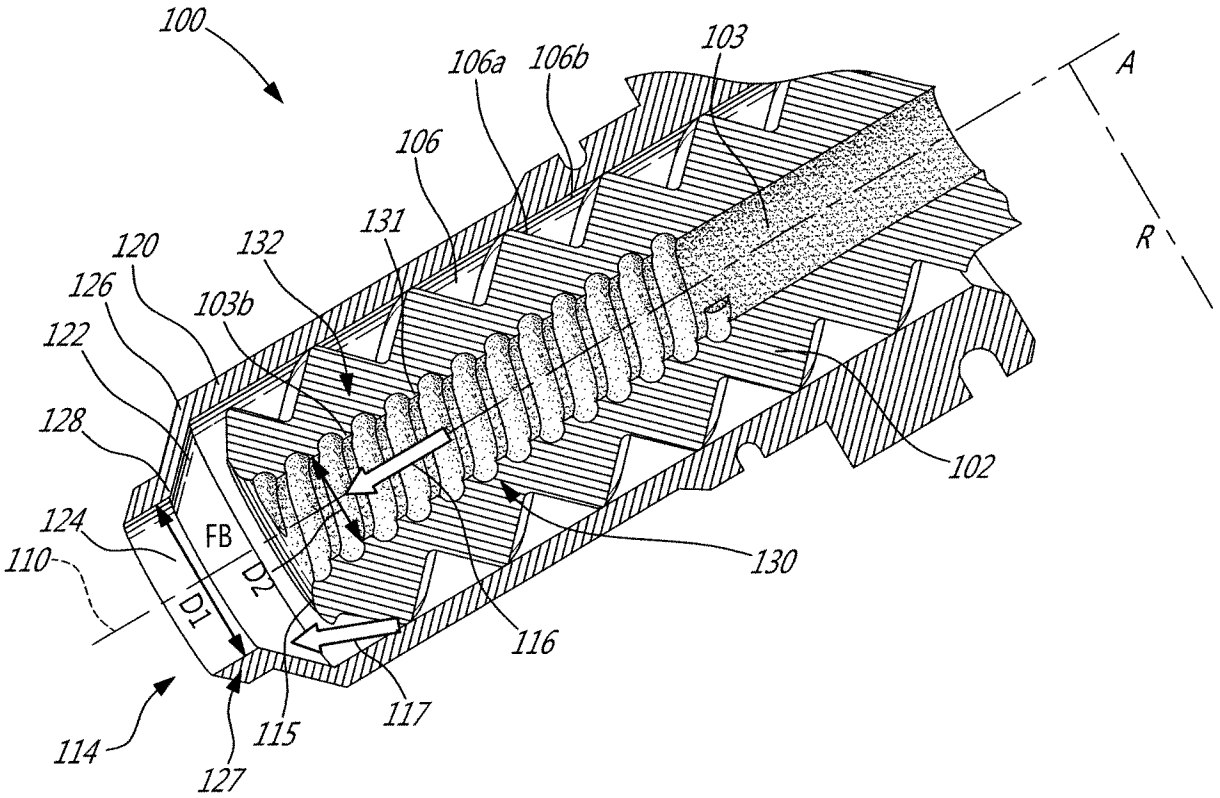
FIG. 2 is a partial schematic cross-sectional view of an embodiment of a nozzle for the combustor of the gas turbine engine of FIG. 1.

Turning now to FIG. 2, an embodiment of a fuel nozzle 100 will be described.

The nozzle 100 includes generally a cylindrical body 102 defining an axial direction A and a radial direction R. The body 102 is at least partially hollow and defines in its interior a primary air passageway 103 (a.k.a. core air) and a fuel passageway 106, all extending axially through the body 102.

The air passageway 103 and the fuel passageway 106 are aligned with a central axis 110 of the nozzle 100. The fuel passageway 106 is disposed concentrically around the air passageway 103. The fuel passageway 106 is annular. It is contemplated that the nozzle 100 could include more than one air passageway 103 and/or fuel passageway 106, annular or not. The size, shape, and number of the fuel 106 and air passageway 103 may vary depending on the flow requirements of the nozzle 100, among other factors. The nozzle 100 could, for example, include a secondary passageway around the fuel passageway 106.

The body 102 includes an upstream end (not shown) connected to sources of pressurised fuel and air and a downstream end 114 at which the air and fuel exit. The terms "upstream" and "downstream" refer to the direction along which fuel flows through the body 102. Therefore, the upstream end of the body 102 corresponds to the portion where fuel/air enters the body 102, and the downstream end 114 corresponds to the portion of the body 102 where fuel/air exits.

The primary air passageway 103 is defined by outer wall **103*b*. The outer wall 103*b* ends at exit end 115. The primary air passageway 103 carries pressurised air illustrated by arrow 116. The air 116** will be referred interchangeably herein to as "air", "jet of air", or "core flow of air".

The fuel passageway 106 is defined by inner wall **106*a* and outer wall 106*b* and carries a fuel film illustrated by arrow 117. The fuel 117 will be referred interchangeably herein to as "fuel" or "fuel film". In the embodiment shown in the Figures, the inner wall 106*a* has a helicoidal relief to induce swirl in the fuel film 117. By "swirl", one should understand any non-streamlined motion of the fluid, e.g. chaotic behavior or turbulence. It is contemplated that the inner wall 106*a* could be straight and/or could have grooves/ridges to induce swirl in the fuel film 117. It is also contemplated that the outer wall 106*b* could have grooves/ridges or that the inner wall 106*a*** could be straight.

The fuel passage 106 is typically convergent (i.e. its cross-sectional area) may decrease along its length, from inlet to outlet) in the downstream direction at the downstream end 114. The outer wall 106*b* of the fuel passageway 106 converging at the downstream end 114 forces the annular fuel film 117 expelled by the fuel passageways 106 onto a jet of air 116 from the primary air passageway 103. The outer wall 106*b* of the fuel passageway 106 includes a first straight portion 120, a second converging portion 122 extending from a downstream end 126 of the straight portion 120, and a third straight portion 124 extending from a downstream end 128 of the converging portion 122. The third straight portion 124 forms an exit lip 127 of the nozzle 100. The lip exit 127 is disposed downstream relative to the exit end 115 of the primary air passageway 103. A diameter D1 of the outer wall 106*b* at the third straight portion 124 is slightly bigger than a diameter D2 of the outer wall 103*b* at the first straight portion 120.

A downstream end portion (or exit lip) 132 of the outer wall 103*b* of the air passageway 103 includes a surface treatment or swirl-inducing relief in the form of a plurality of grooves 130. The grooves 130 define a plurality of ridges 131 between them. The ridges 131 form abrupt transitions in the outer wall 103*b* and induce swirl in the core flow of air 116 as it exits the air passageway 103. By inducing swirl to the core air, shearing forces between the fuel film 117 and the air 116 may be increased. The shearing induces better mixing between the air and the fuel, better breakdown of the fuel. In turn, a size of the fuel droplets created may be reduced.

The grooves 130 in the illustrated embodiment are disposed up to the exit end 115 of the air passageway 103 in order to ensure that the air swirling is sustained to a fuel breakdown region FB, right after the exit of the air passageway 103 at about the third straight portion 124.

In the embodiment shown in the Figures, the grooves 130 are circumferential, helicoidal and of round cross-section. It is contemplated that the grooves 130 could have various shapes, for example, the grooves 130 could be axial, circular, of a rectangular cross-section, or of a triangular cross-section. The grooves 130 could be continuous or discontinuous.

Figure 3A:
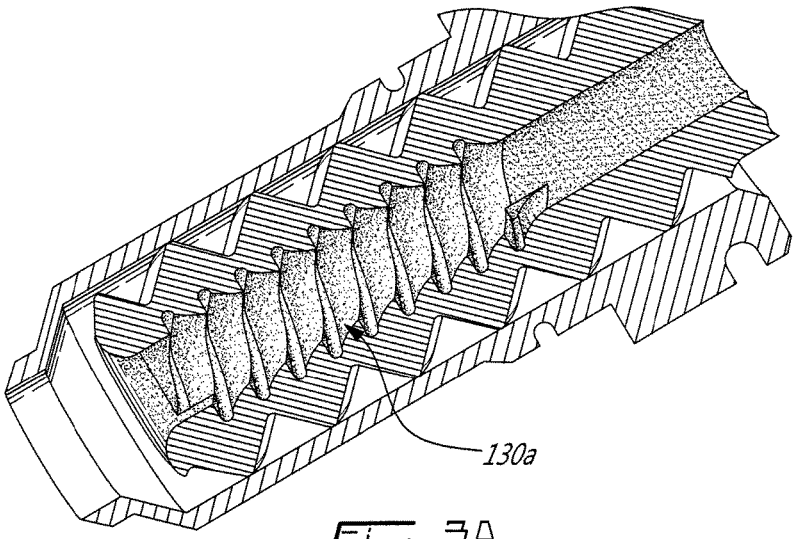
FIGS. 3A and 3B illustrate alternative designs of swirl-inducing reliefs of the nozzle of FIG. 2.
Figure 3B:
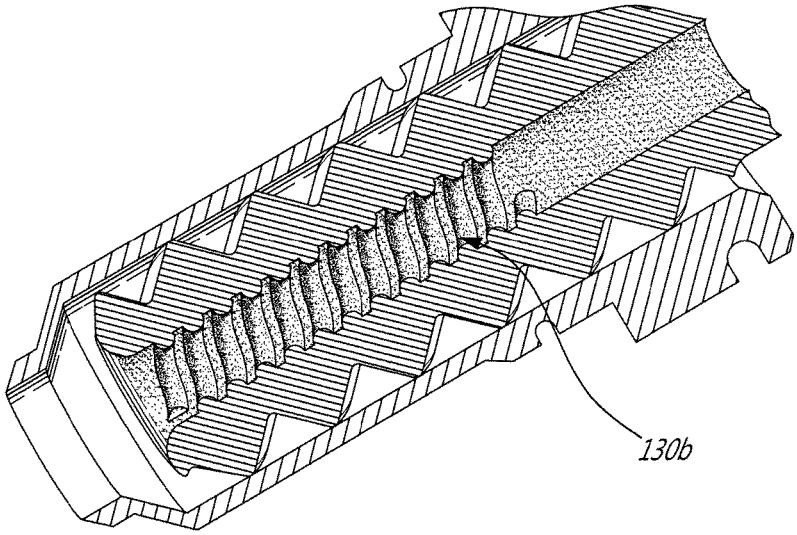

FIGS. 3A and 3B show examples of alternative of designs of the relief of the downstream end portion 132 of the air passageway 130. Grooves 130*a* in FIG. 3A have a sawtooth cross-section, and the grooves in FIG. 3B are replaced by protrusion 130*b* extending inwardly from the outer wall 103*b*. The protrusions 130*b* could also be substitute by vanes, which may be disposed circumferentially along the outer wall 103*b*.

The relief of the outer wall 103*b* may have various aspects, as long as it induces some sort of non-streamline behavior, e.g. turbulence, swirl or chaotic behavior in the air 116. The relief could be right at the exit end 115 of the air passageway 103, as shown in the Figures, or slightly upstream of the exit end 115.

The nozzle 100 may include one or more secondary air passageway(s) sandwiching the fuel film 117 with the core flow of air 116. The secondary air passageway(s) may include grooves similar to the grooves 130 or protrusion/ridges to induce swirl in the secondary stream of air. The grooves may be of the same type (e.g. helicoid) with the same characteristics (e.g. angle of the helix) as the grooves 130 or could be different.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A fuel nozzle for a combustor of a gas turbine engine, the fuel nozzle comprising:

a body defining an axial direction and a radial direction, the body defining an air passageway and a fuel passageway each extending axially through the fuel nozzle, the air passageway being centrally disposed within the body and the fuel passageway being annular and disposed radially outward of the air passageway, the body accommodated within an annular duct having a converging section at a downstream end thereof and terminating at an exit lip of the fuel nozzle, a mixing zone defined within the converging section of the annular duct downstream of the body; and the air passageway having a swirl-inducing relief defined at an exit of an outer wall of the air passageway upstream of the mixing zone, the swirl-inducing relief including a plurality of helicoidal grooves formed into an inner surface of the outer wall of the air passageway.

2. The fuel nozzle of claim 1, wherein the swirl-inducing relief extends on the outer wall up to a downstream end of the air passageway.

3. The fuel nozzle of claim 1, wherein the plurality of grooves are circular in cross-section.

4. The fuel nozzle of claim 1, wherein the plurality of grooves have a sawtooth cross-sectional shape.

5. The fuel nozzle of claim 1, wherein a downstream end of the air passageway is axially upstream relative to a downstream end of the fuel passageway.

6. A gas turbine engine comprising:

a combustor; and a plurality of fuel nozzles disposed inside the combustor, each of the fuel nozzles including:

a body defining an axial direction and a radial direction, the body accommodated within an annular duct having a converging section at a downstream end thereof and terminating at an exit lip of the fuel nozzle, a mixing zone defined within the converging section of the annular duct downstream of the body;

an air passageway extending axially through the body at a center thereof; and a fuel passageway extending axially through the body radially outwardly from the air passageway, the air passageway having a swirl-inducing relief at an exit lip of an outer wall of the air passageway, the swirl-inducing relief including a plurality of helicoidal grooves formed into an inner surface of the outer wall of the air passageway to induce swirl to an air flow exiting the air passageway and entering the mixing zone.

7. The gas turbine engine of claim 6, wherein the swirl-inducing relief extends on the outer wall up to a downstream end of the air passageway.

8. The gas turbine engine of claim 6, wherein the plurality of grooves are circular in cross-section.

9. The gas turbine engine of claim 6, wherein the plurality of grooves have a sawtooth cross-sectional shape.

10. The gas turbine engine of claim 6, wherein a downstream end of the air passageway is axially upstream relative to a downstream end of the fuel passageway.

* * * * *